US005305826A

United States Patent [19]

Couëtoux

[11] Patent Number: 5,305,826

[45] Date of Patent: Apr. 26, 1994

[54] MOTOR VEHICLE RADIATOR HAVING A FLUID FLOW CONTROL DEVICE

[75] Inventor: Hervé Couëtoux, Versailles, France

[73] Assignee: Valeo Thermique Moteur, France

[21] Appl. No.: 840,322

[22] Filed: Feb. 24, 1992

[30] Foreign Application Priority Data

Feb. 26, 1991 [FR] France ..... 91 02284

[51] Int. Cl.[5] ..... F28F 27/02; F01P 3/18

[52] U.S. Cl. ..... 165/103; 165/35; 165/39; 236/34.5; 123/41.08; 123/41.1

[58] Field of Search ..... 165/51, 39, 40, 35, 165/96, 103; 236/34.5; 123/41.08, 41.09

[56] References Cited

U.S. PATENT DOCUMENTS

| | | | |
|---|---|---|---|
| 1,377,874 | 5/1921 | Church | 236/34.5 |
| 1,414,780 | 5/1922 | Giesler . | |
| 1,578,805 | 3/1926 | Cooper | 236/34.5 |
| 2,288,599 | 7/1942 | Ramsaur . | |
| 2,322,047 | 6/1943 | Mormile | 236/34.5 |
| 2,540,629 | 2/1951 | Miller . | |
| 2,650,767 | 9/1953 | Nemer et al. . | |
| 2,670,933 | 3/1954 | Bay . | |
| 3,246,637 | 4/1966 | Walsh | 236/34.5 |
| 4,327,673 | 5/1982 | Schroeder | 236/34.5 |
| 4,399,776 | 8/1983 | Shikata | 236/34.5 |
| 4,432,410 | 2/1984 | Cadars | 236/34.5 |

FOREIGN PATENT DOCUMENTS

| | | | |
|---|---|---|---|
| 1079893 | 4/1960 | Fed. Rep. of Germany | 123/41.1 |
| 3232320 | 3/1984 | Fed. Rep. of Germany | 165/96 |
| 1466329 | 9/1965 | France . | |
| 2481791 | 5/1980 | France . | |
| 0490631 | 2/1954 | Italy | 165/35 |
| 0031838 | 3/1979 | Japan | 236/34.5 |
| 0421938 | 1/1935 | United Kingdom | 236/34.5 |

*Primary Examiner*—John K. Ford
*Attorney, Agent, or Firm*—Morgan & Finnegan

[57] ABSTRACT

A cooling radiator for the engine of a motor vehicle includes two movable masking members associated with the same fluid manifold of the radiator and actuated by a common actuator in response to the engine temperature. A first of these masking members closes the inlet of the manifold to prevent any flow in the radiator when the engine is cold. The second masking member controls an aperture in an intermediate bulkhead in the fluid manifold so that a variable fraction of the fluid flow in the radiator is diverted (when the manifold inlet is open) through the aperture, so that it does not pass through the tubes of the radiator. This radiator performs the function of a thermostat and also regulates the cooling function at the correct efficiency according to the power being produced by the engine.

4 Claims, 3 Drawing Sheets

MOTOR VEHICLE RADIATOR HAVING A FLUID FLOW CONTROL DEVICE

FIELD OF THE INVENTION

This invention is concerned with a cooling radiator for a heat engine of a motor vehicle, having a control device for regulating the circulation of the cooling fluid.

BACKGROUND OF THE INVENTION

U.S. Pat. No. 4,432,410 and the corresponding French published patent application No. FR 2 481 791A describe a radiator of the above kind, comprising a fluid manifold having a tube branch for inlet or outlet of a cooling fluid, and a bundle of tubes the ends of which are open into the said fluid manifold, together with a bulkhead formed with an aperture and dividing the fluid manifold into a first chamber and a second chamber. The ends of a first group of the tubes, and the said inlet or outlet tube branch, are open into the first chamber, while the complementary group of tube ends is open into the second chamber. The radiator also includes a first masking or valve member for opening the aperture in the bulkhead, this masking member being movable by an actuator between an opening position and a closing position. In the opening position, the masking member enables the fluid passing into the fluid manifold through the inlet tube branch, or leaving it through the outlet tube branch, to be able to pass directly from the first chamber to the second chamber or vice versa. In the closing position, the masking member forces the fluid to pass through the tubes of the first group.

In that known radiator, the flow control device defined by the first masking member and the actuator serves the function of the traditional thermostat which is commonly placed on the outside of the radiator. Its effect is to suppress the circulation of the fluid in all or some of the tubes of the radiator when the engine is cold, and to set up normal circulation in all the tubes once the engine is sufficiently hot, i.e. after a certain running time.

In order to optimise the engine power output, it is desirable that it shall work at a constant temperature, which makes it necessary to cause the efficiency of its cooling to vary as a function of the heat energy which it emits, and therefore as a function of its loading. In order to make the cooling efficiency vary, and thus to regulate the temperature of the engine, it is possible to act on various parameters, and in particular on the flow of the fluid passing through the tubes of the radiator. To this end it is known to arrange, in series with the radiator, a flow regulating valve controlled by a cooling fluid temperature sensor placed at the fluid outlet of the engine. The use of such a regulating valve complicates the construction of the cooling circuit. In addition, rotary valves, such as are commonly used, do not have a sufficiently progressive regulating action at low rates of fluid flow.

DISCUSSION OF THE INVENTION

An object of the present invention is to improve the radiator defined under the heading "Field of the Invention" above, in such a way that it will itself regulate the flow of fluid in the tubes, thus rendering the provision of a regulating valve in series with the radiator superfluous.

To this end, in accordance with the invention the radiator further includes a second masking or valve member, which is movable by the same actuator as the first masking member between an opening position and a closing position whereby to enable or to interrupt, respectively, communication between the inlet or outlet tube branch and the first chamber, the actuator being arranged (a) to pass from a first state, in which the second masking member is in its closing position preventing any circulation of fluid in the radiator, and a second state in which the second masking member is in its open position and the first masking member is in a first of its said opening and closing positions, so that the fluid that passes into the first chamber can flow in all the tubes of the radiator or vice versa, and (b) to pass through or assume an intermediate state in which the second masking member is in its open position and the first masking member is in the second of its said positions, to cause the fluid to flow in only some of the tubes, or alternatively to cause only some of the fluid to flow in the tubes.

In one embodiment of the invention, the two masking members are coupled to each other rigidly and are actuated simultaneously by the actuator. The two masking members may then assume their closing positions respectively at the two end points of the travel of the actuator, and both be in the opening position over the intermediate part of the travel.

A flow control device operating in this way is suitable for a radiator of the U-shaped or double pass configuration, with the fluid being admitted and removed through the two respective chambers of the fluid manifold and with opening of the aperture in the bulkhead defining a fluid bypass for all of the tubes.

It is also suitable for a radiator of the Z-shaped or triple pass configuration having a counter manifold or second fluid manifold mounted at the opposite end of the tube bundle from the first fluid manifold, with the second fluid manifold being divided by a bulkhead into a first chamber into which a fluid inlet or outlet tube branch is open, and a second chamber, with a first group of the tubes connecting the first chamber of the first fluid manifold with the second chamber of the second fluid manifold, a second group of the tubes connecting the second chamber of the first fluid manifold with the first chamber of the second fluid manifold, and with the remainder of the tubes, i.e. a third group of tubes, connecting together the second chambers of the first and second fluid manifolds, so that when the aperture in the bulkhead of the first fluid manifold is open, it defines a fluid bypass for the first and third groups of tubes.

The term "counter manifold", as used here, simply means a second fluid manifold, and is used to distinguish the latter from the first fluid manifold which is equipped with the flow control device. In the case in which the inlet tube branch is open into the first fluid manifold, then the outlet tube branch is open into the second fluid manifold, and vice versa.

In accordance with a second embodiment of the invention, the first masking member is coupled to the second masking member in such a way as to remain immobile, preferably in the closing position, over part of the travel of the second masking member adjacent to the closing position of the latter, and to be rigidly coupled with it over the rest of its travel. This type of control device is suitable for a radiator of single pass or I-shaped configuration, which includes a fluid counter manifold having no bulkhead, and into which a fluid inlet or outlet tube branch is open, the counter manifold being connected to the first fluid manifold through all of the tubes. Closing of the aperture in the bulkhead of the first fluid manifold then prevents fluid from passing into the second chamber of the latter and into the tubes that are open into the second chamber.

Further features and advantages of the invention will appear more clearly from the description of preferred embodiments of the invention, which is given below by way of example only and with reference to the accompanying drawings.

DESCRIPTION OF PREFERRED EMBODIMENTS OF THE INVENTION

Figure 1:
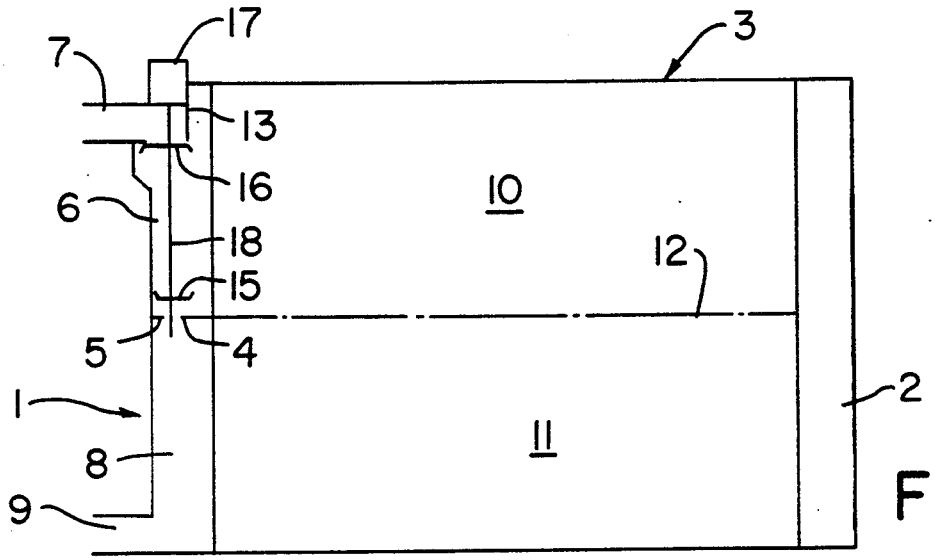
FIGS. 1 to 3 show diagrammatically a first embodiment of a radiator in accordance with the invention, with each Figure showing it in a different state.
Figure 2:
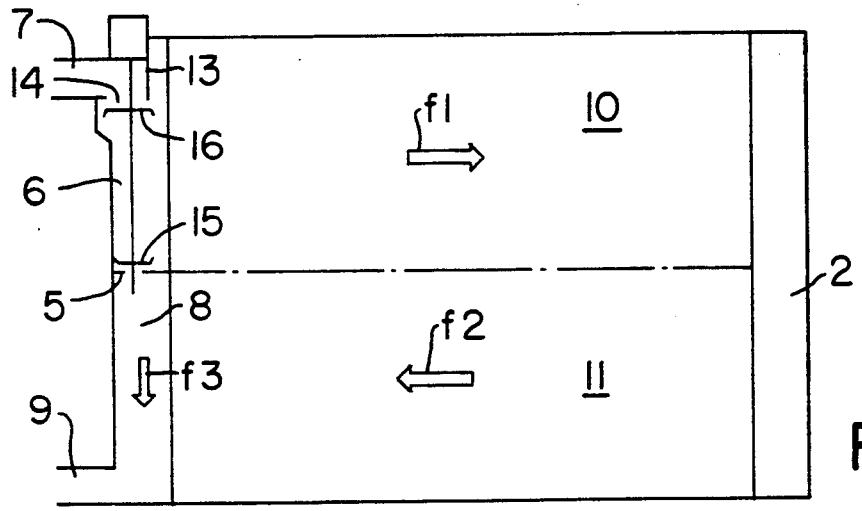
Figure 3:
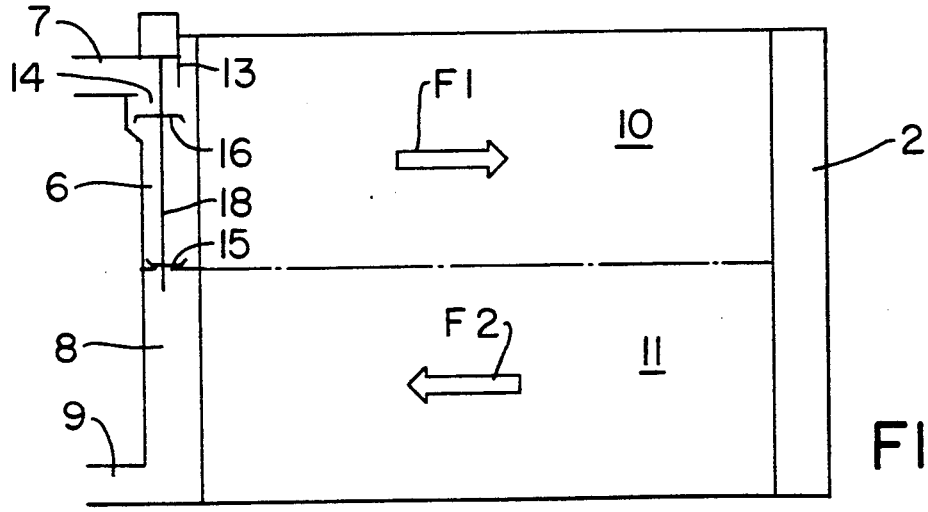

The cooling radiator shown in FIGS. 1 to 3 comprises a first or main fluid manifold 1 and a counter manifold 2, between which there extends a bundle 3 of parallel tubes which are not shown individually. The two ends of each tube are open into, respectively, the fluid manifold 1 and the fluid manifold 2. A transverse bulkhead 4, in which an aperture 5 is formed, divides the interior of the manifold 1 into a chamber 6 and a chamber 8. The cooling fluid is arranged to pass into the radiator by entry into the chamber 6 via an inlet tube branch 7. The chamber 8 communicates with an outlet tube branch 9 for the fluid. A first sub-assembly 10 of tubes in the bundle 3 is open into the chamber 6, and the complementary sub-assembly 11 is open into the chamber 8. The boundary between these two sub-assemblies is indicated diagrammatically by a phantom line 12.

A second bulkhead 13, having an aperture 14, separates the chamber 6 from the inlet tube branch 7. The aperture 5 in the bulkhead 4 and the aperture 14 in the bulkhead 13 are able to be closed respectively by valve or masking members 15 and 16, which are actuated together by an actuator 17, through a rod 18 on which they are fixed. The appropriate characteristics of the actuator 17 do not form part of the present invention. It may contain a substance having a high coefficient of thermal expansion, such as a wax in which changes of volume cause the movement of the rod 18 to occur. This substance may be heated directly by the coolant fluid after leaving the engine of the vehicle, and/or by an electric current which is controlled according to appropriate parameters related to the running of the engine. The actuator may also use an alloy having a thermal memory, or an electric motor.

In the position shown in FIG. 1, the second masking member 16 closes the aperture 14, and the cooling fluid is unable to enter into the radiator. The fluid is all diverted into one or more branches of the circuit outside the radiator, for example into a heat exchanger for heating the cabin of the vehicle. This position subsists when the engine is cold, and enables the temperature of the latter to be rapidly raised to its working level. It is also possible to see from FIG. 1 that the first masking member 15 is spaced away from the aperture 5, thus enabling the chambers 6 and 8 to communicate with each other, but this is neither here nor there in the absence of any circulation of fluid in the radiator.

The position shown in FIG. 3 corresponds to the end of the travel of the rod 18 opposite to that corresponding to FIG. 1. The masking member 16 is spaced away from the aperture 14, thus enabling the fluid to pass into the chamber 6. By contrast, the aperture 5 is now closed by the masking member 15, preventing any direct communication between the chambers 6 and 8. All of the fluid entering the radiator thus passes from the chamber 6 into the manifold 2 via the tubes of the sub-assembly 10 (as indicated by the arrow Fl), and passes from the manifold 2 into the chamber 6 through the tubes of the sub-assembly 11 (as indicated by the arrow F2), before leaving via the outlet tube branch 9. The radiator thus functions in the conventional way as a U-shaped or double pass heat exchanger. Its cooling efficiency is maximised. This position exists when the engine of the vehicle is running fast and gives out a large amount of heat.

In the intermediate part of the travel of the rod 18, as shown in FIG. 2, the apertures 5 and 14 are both disengaged by the masking members 15 and 16 respectively. Part of the fluid stream penetrating into the chamber 6 through the aperture 14 follows the same path as in FIG. 3 and as indicated by arrow fl, from the chamber 6 to the manifold 2 via the tubes 10, and then as indicated by the arrow f2, from the manifold 2 to the chamber 8 via the tubes 11. The remainder of the fluid stream passes directly from the chamber 6 to the chamber 8 through the aperture 5 as indicated by the arrow f3. This second portion of the fluid is hardly cooled by its passage through the radiator, which limits the efficiency of the latter. The proportion of fluid passing through the tubes, and therefore the cooling efficiency, increases progressively as the rod 18 is displaced from the position of FIG. 1 towards that of FIG. 3. It is thus possible to regulate the temperature of the engine by causing the efficiency of cooling to vary according to the load on the engine. Having regard to the hydraulic losses in the other branches of the cooling circuit, the total fluid flow into the radiator may also vary progressively according to the position of the masking member 16, over at least part of its travel, thus contributing to the regulating action.

Figure 4:
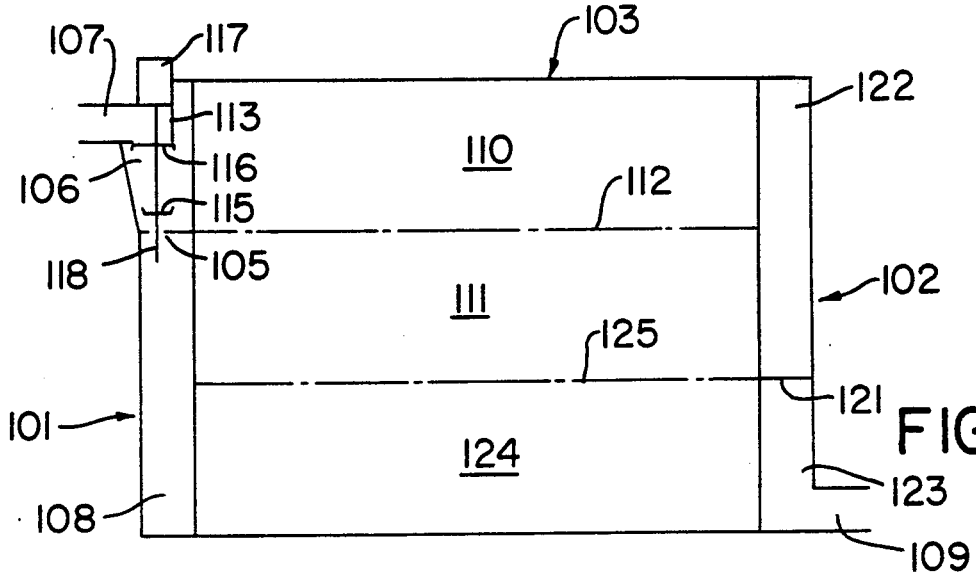
FIGS. 4 to 6 are views similar to FIGS. 1 to 3 but showing a second embodiment.
Figure 5:
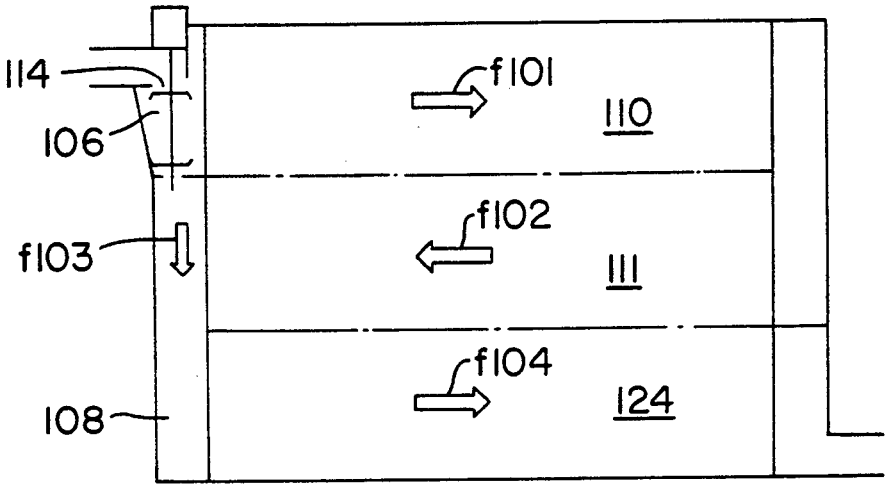
Figure 6:
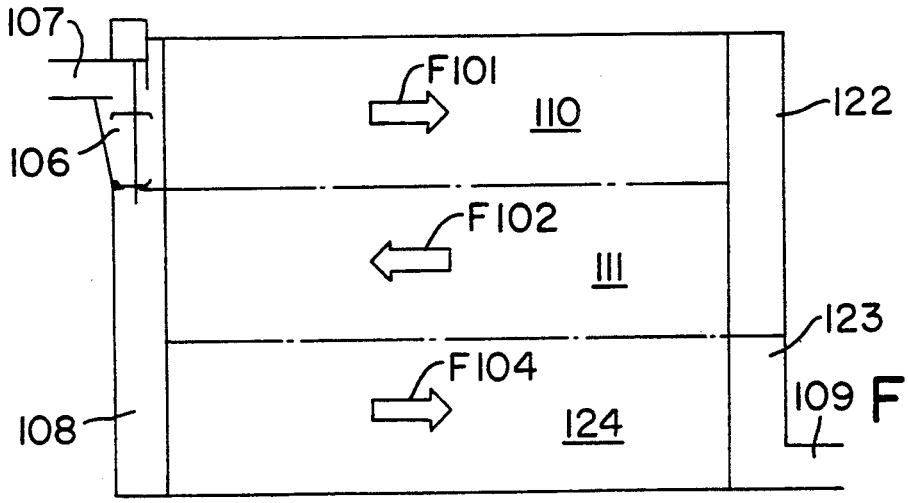

The radiator shown diagrammatically in FIGS. 4 to 6 includes elements which are identical or similar to those in FIGS. 1 to 3 and which are designated by the same reference numerals increased by 100. The differences between the radiator of FIGS. 4 to 6 and that of FIGS. 1 to 3 are described below. The manifold 102, at the opposite end from the fluid manifold 101 through which the cooling fluid enters the radiator via the inlet tube branch 107, is divided by a solid bulkhead 121 into two chambers 122 and 123. The outlet tube branch 103 opens into the chamber 103 of the fluid manifold 102 and not into the chamber 108 of the fluid manifold 101. The tubes of the bundle 103 are divided into three groups 110, 111 and 124, with the tubes of the group 110 connecting the chambers 106 and 122 together, those of the group 111 connecting the chambers 122 and 108 together, and those of the group 124 connecting the chambers 108 and 123 together.

The positions of the first and second masking members 116 and 115, which control, respectively, the entry of fluid into the chamber 106 and communication between the latter and the chamber 108 in cooperation with the corresponding apertures 114 and 105, are the same in FIGS. 4 to 6 as the positions of the corresponding masking members 16 and 15 in FIGS. 1 to 3 respectively. In the position shown in FIG. 4, as in the case of FIG. 1, the radiator is out of circuit. In the position shown in FIG. 6, it operates in a triple pass or Z-shaped configuration. All of the fluid that enters the chamber 106 via the inlet tube branch 107 passes successively into the tubes of the group 110 (as indicated by the arrow F101), the chamber 122, the tubes of the group 111 (as indicated by the arrow F102), the chamber 108, the tubes of the group 124 (as indicated by the arrow F104), and the chamber 123, from which it drains via the outlet tube branch 109.

In the position shown in FIG. 5, a proportion of the fluid stream which passes into the chamber 106 follows the circuit that has just been described, the path through the tubes being indicated by the arrows f101, f102 and f104, while the remainder of the fluid passes directly via the aperture 105 from the chamber 106 to the chamber 108 as indicated by the arrow f103, where it rejoins the first fraction. The effects of this radiator are the same as those of the radiator shown in FIGS. 1 to 3 up to this point except that in the intermediate position seen in FIG. 5, all of the fluid circulating in the radiator passes through the tubes in the group 124 as indicated by the arrow f104. Everything else being equal, the efficiency of the radiator in this position is thus slightly increased.

Figure 7:
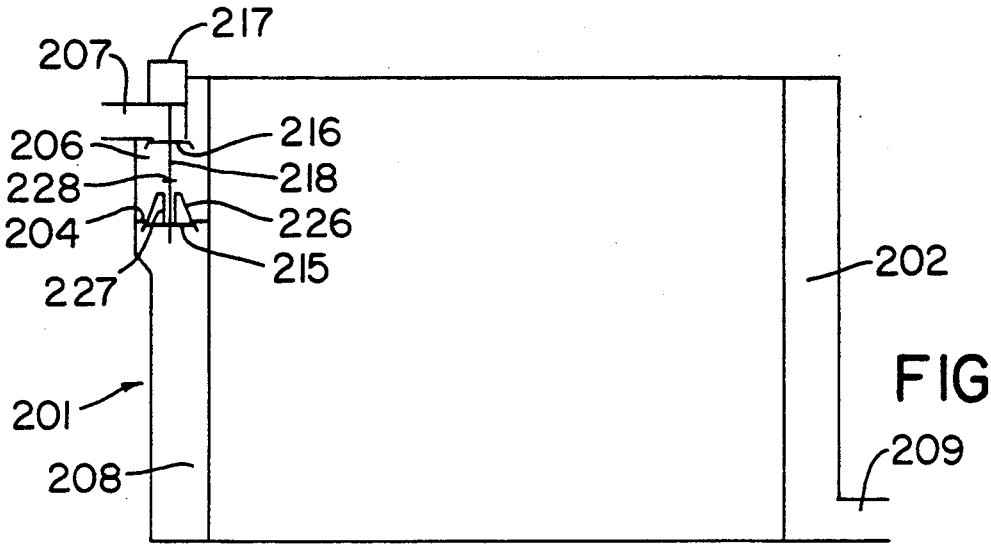
FIGS. 7 to 9 are, again, views similar to FIGS. 1 to 3, but show a third embodiment.
Figure 8:
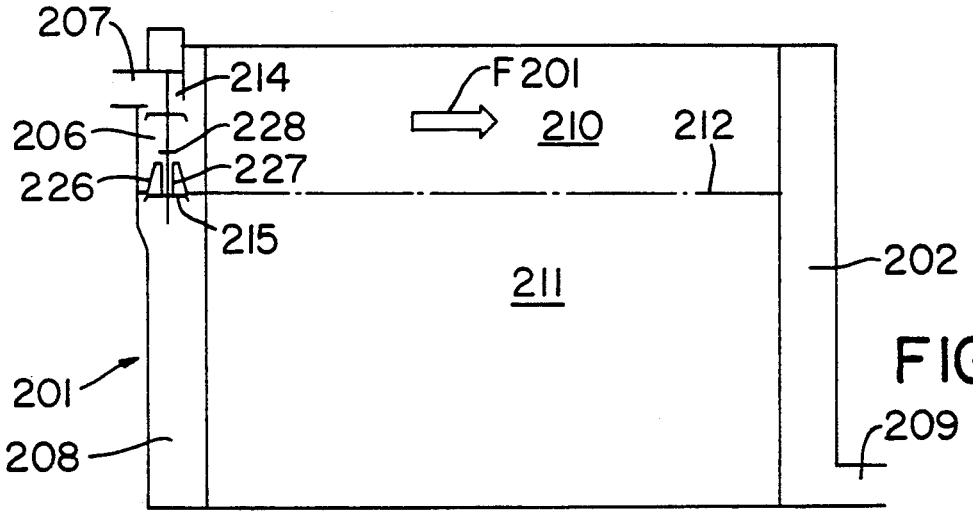
Figure 9:
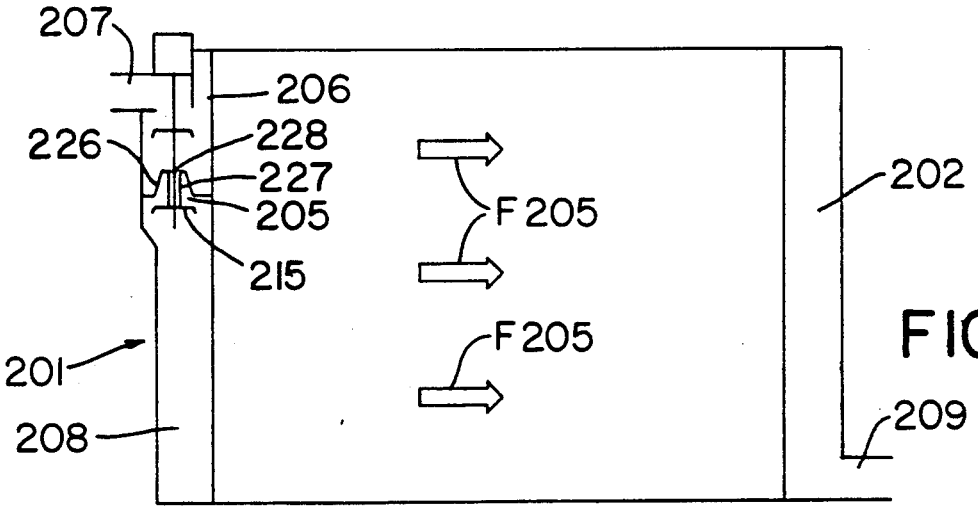

The radiator shown diagrammatically in FIGS. 7 to 9 also includes elements that are identical or similar to those in FIGS. 1 to 3, and which are designated by the same reference numerals but increased by the number 200. The differences between the radiator shown in FIGS. 1 to 3 and that shown in FIGS. 7 to 9 are described below. The outlet tube branch 209 of the radiator opens into the fluid manifold 202 opposite to the fluid manifold 201 through which the fluid passes into the radiator via the inlet tube branch 207. The tubes of the group 210, which are open into the chamber 206 of the manifold 201, communicate with the inlet tube branch 207 via the aperture 214 and preferably have a total flow cross section which is substantially smaller than that of the tubes in the group 211, which open into the other chamber 208 of the same fluid manifold 201, whereas the flow cross sections of the tubes in the groups 10 and 11 in the first embodiment were preferably substantially equal.

Although the masking member 216 is fixed to the rod 218 of the actuator 217, and operates in the same way as the masking member 16 in the first embodiment, the masking member 215 associated with the aperture 205 in the bulkhead 204, separating the chambers 206 and 208, is mounted for sliding movement on the rod 218 by means of a sleeve 227 surrounding the latter. The masking member 215 is biassed by a spring 226 which tends to apply it against the surface of the bulkhead 204 which is facing towards the chamber 208, in such a way as to close off the aperture 205. The sliding movement of the masking member 215 on the rod 218 under the action of the spring 226 is limited by a shoulder or widened portion 228 of the rod, against which the sleeve 227 comes into abutment. In the positions shown in FIGS. 7 and 8, the abutment 228 is spaced away from the sleeve 227, and the spring 226 applies the masking member 215 against the aperture 205 so as to close off the latter. In the position shown in FIG. 8, all of the cooling fluid that penetrates into the chamber 206 through the aperture 214 passes through the tubes of the group 210 so as to reach the fluid manifold 202, which it leaves via the outlet tube branch 209. In the position shown in FIG. 9, the rod 218 pushes the sleeve 227 by means of the abutment 228, thus compressing the spring 226, and the masking member 215 opens the aperture 205. A fraction of the cooling fluid can thus pass through the latter and into the chamber 208, so that the fluid passes through all of the tubes of the bundle 203 (as indicated by the arrows F205), to reach the fluid manifold 202. The radiator thus operates in a single pass or I-shaped configuration. In the intermediate position seen in FIG. 8, by contrast with the cases shown in FIGS. 2 and 5, all of the fluid passing into the radiator circulates through the cooling tubes of the group 210. However, the heat exchange surface is substantially reduced by comparison with the configuration in FIG. 9. In addition, the limitation of the number of tubes through which the fluid passes involves an increase in the loss of hydraulic energy across the radiator, and consequently a modification of the distribution of flows in the circuit, to the detriment of the latter. These two factors contribute to a reduction in the efficiency of the radiator, which again enables the temperature of the engine to be regulated.

The connection between the actuator 17, 117 or 217 and the masking members 15, 115 or 215 and 16, 116 or 216, as described above, may in practice be obtained by any known means. In addition the geometrical relationship of these elements may be different from that which is shown diagrammatically in the drawings. Also, in the radiator of FIGS. 1 to 3, the tubes of the groups 10 and 11 and the fluid manifold 2 may be replaced in known manner by curved U-tubes, with the two ends of each tube being open respectively into the chambers 6 and 8.

What is claimed is:

1. A radiator for a motor vehicle comprising:

a fluid manifold;

a divider separating said manifold into first and second chambers, said radiator further including an inlet port selectively fluidly communicable with said first chamber and an outlet port fluidly in communication with said second chamber;

a first set of tube members having open ends communicating with said first chamber;

a second set of tube members having open ends communicating with said second chamber;

a first valve member cooperable with said divider for permitting direct fluid communication between said first and second chambers;

a second valve member for permitting fluid communication between said inlet and said first chamber; and an actuator member coupled to said first and second valve members for simultaneous operation of such valves such that said actuator is operable to (a) close said second valve to prevent fluid flow through said inlet into the radiator; (b) close said first valve member and open said second valve member to permit fluid flow through said inlet, said first chamber, said first set of tubes, said second set of tubes, said second chamber, and said outlet; and (c) open both said first and second valves a predetermined amount to permit a first regulatable fluid flow through said inlet, said first chamber, directly through said second chamber and through said outlet, and a second regulatable fluid flow through said inlet, said first chamber, said first and second sets of tube members, said second chamber, and said outlet.

2. A radiator according to claim 1, wherein the two valve members are rigidly coupled together for simultaneous operation by the actuator and wherein said actuator is movable between two ends of travel.

3. A radiator according to claim 2, wherein the two valve members are arranged to be in their closing positions respectively at the two ends of the travel of the actuator, with both valve members being in their open positions when the actuator is in an intermediate state between the two ends of its travel.

4. A radiator for a motor vehicle comprising:

a first fluid manifold;

a first divider separating said first manifold into first and second chambers, said radiator further including an inlet port selectively fluidly communicable with said first chamber of said first manifold;

a second fluid manifold;

a second divider separating said second manifold into first and second chambers, said second chamber of said second manifold having a fluid outlet;

a first set of tube members having open ends communicating with said first chambers of said first and second manifolds;

a second set of tube members, each tube member having one open end communicating with the second chamber of the first manifold and another open end communicating with the first chamber of the second manifold;

a third set of tube members having open ends communicating with said second chambers of said first and second manifolds;

a first valve member cooperable with said first divider for permitting direct fluid communication between said first and second chambers of said first manifold;

a second valve member for permitting fluid communication between said inlet and said first chamber; and an actuator member coupled to said first and second valve members for simultaneous operation of said valve members such that said actuator is operable to (a) close said second valve to prevent fluid flow through said inlet into the radiator; (b) close said first valve member and open said second valve member to permit fluid flow through said inlet, said first chamber of said first manifold, said first set of tube members, said first chamber of said second manifold, said second set of tube members, said second chamber of said first manifold, said third set of tube members, said second chamber of said second manifold, and said outlet; and (c) open both said first and second valve members a predetermined amount to permit a first regulatable fluid flow through said inlet, said first chamber of said first manifold, directly through said second chamber of said first manifold, through said third set of tube members, said second chamber of said second manifold, and through said outlet, and a second regulatable fluid flow through said inlet, said first chamber of said first manifold, said first set of tube members, said first chamber of said second manifold, said second set of tube members, said second chamber of said first manifold, said third set of tube members, said second chamber of said second manifold and out said outlet.

* * * * *